US009341054B2

(12) United States Patent
Harman et al.

(10) Patent No.: US 9,341,054 B2
(45) **Date of Patent: *May 17, 2016**

(54) SYSTEM FOR MONITORING LINEARITY OF DOWN-HOLE PUMPING SYSTEMS DURING DEPLOYMENT AND RELATED METHODS

(71) Applicant: Baker Hughes Incorporated, Houston, TX (US)

(72) Inventors: Robert M Harman, Troutville, VA (US); Brooks A. Childers, Christianburg, VA (US); Philippe J. Legrand, The Woodlands, TX (US); Malcolm S. Laing, Blacksburg, VA (US); Roger G. Duncan, Christianburg, VA (US); Suresha R. O'Bryan, Joplin, MO (US); Ketankumar K. Sheth, Tulsa, OK (US); Earl B. Brookbank, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/590,228

(22) Filed: Jan. 6, 2015

(65) Prior Publication Data

US 2015/0129206 A1 May 14, 2015

Related U.S. Application Data

(63) Continuation of application No. 13/234,667, filed on Sep. 16, 2011, now Pat. No. 8,950,472.

(51) Int. Cl.
*E21B 47/12* (2012.01)
*E21B 47/00* (2012.01)

(Continued)

(52) U.S. Cl.
CPC ..... *E21B 47/0007* (2013.01); *E21B 17/003* (2013.01); *E21B 43/128* (2013.01); *E21B 47/12* (2013.01); *E21B 47/123* (2013.01); *F04B 47/02* (2013.01)

(58) Field of Classification Search
CPC ..... E21B 47/0007; E21B 47/123
See application file for complete search history.

(56) References Cited

U.S. PATENT DOCUMENTS 6,888,124 B1 5/2005 Smith
7,159,653 B2 1/2007 Vold (Continued)

OTHER PUBLICATIONS

B. Childers, "Donwhole Fiber Optic Real-Time Casing Monitor," Industrial and Commercial Applications of Smart Structures Technologies 2007, Proc. of SPIE, vol. 6527, 65270J (2007).

(Continued)

*Primary Examiner* — Giovanna C Wright
(74) *Attorney, Agent, or Firm* — Bracewell LLP

(57) ABSTRACT

Systems, program product, and methods for monitoring linearity of a down-hole pumping system assembly during deployment within a bore of a casing of a well positioned to extract hydrocarbons from a subterranean reservoir and selecting an optimal operational position for the down-hole pumping system assembly within the bore of the casing, are provided. Various embodiments of the systems allow an operator to ensure that a motor and pump of a down-hole pumping system assembly are installed in an optimal position in a well by ensuring alignment across the pump stages casing and motor casing. The system includes a groove extending along an outer surface of a housing of the pumping system assembly, and an optical sensing fiber mounted in the groove.

20 Claims, 7 Drawing Sheets

(51) Int. Cl.

| | |
|---|---|
| ***E21B 43/12*** | (2006.01) |
| ***F04B 47/02*** | (2006.01) |
| ***E21B 17/00*** | (2006.01) |

(56) References Cited

U.S. PATENT DOCUMENTS

| | | | | |
|---|---|---|---|---|
| 7,282,698 | B2 | 10/2007 | Childers | |
| 8,950,472 | B2 * | 2/2015 | Harman et al. | 166/68 |
| 2007/0272406 | A1 | 11/2007 | McCoy et al. | |
| 2009/0010773 | A1 * | 1/2009 | Parmeter et al. | 417/410.1 |
| 2011/0002795 | A1 | 1/2011 | Brookbank | |
| 2011/0185807 | A1 | 8/2011 | Albrecht et al. | |

OTHER PUBLICATIONS

X. Li, "Evaluating a Concept of Using Distributed Optical Fiber Temperature and Strain Sensor for Continuous Monitoring of Casing and Completion of Mechanical Deformation in Intelligent Wells," Offshore Technology Conference May 3-6, 2004, held at Houston, TX USA.

* cited by examiner

SYSTEM FOR MONITORING LINEARITY OF DOWN-HOLE PUMPING SYSTEMS DURING DEPLOYMENT AND RELATED METHODS

CROSS REFERENCE TO RELATED APPLICATION

This application is a continuation of Ser. No. 13/234,667, filed Sep. 16, 2011.

BACKGROUND OF THE INVENTION

1. Field of the Invention

The present invention relates generally to fluid pumping equipment management. More specifically, the present invention relates to systems, apparatus, program product and methods for ensuring linearity of down-hole pumping systems.

2. Description of the Related Art

An oil and gas reservoir is composed of porous and permeable rock such as limestone, sandstone, or clay which contains oil in its pores. The oil and gas stored in the reservoir is prevented from reaching the surface due to an impermeable rock such as, for example, basalt, granite, or shale. The oil and gas within the reservoir can exert a substantial amount of vertical pressure on the impermeable rock.

Portions of an oil and gas well can be extended through the non-permeable rock to access the oil and gas in the reservoir. The typical oil and gas well can be thought of as a hole in the ground in which a steel pipe called a casing is placed. The annular space between the casing and the formation rock is filled with cement ideally resulting in a smooth steel lined hole in the ground passing through the reservoir. The steel casing is generally fairly uniformly cylindrically shaped along most of the length of the casing, and even in areas where there is a significant bend toward horizontal the steel casing is still fairly uniform around the circumference. The "hole" formed by a drill bit is not always so cylindrically or circumferentially shaped. This difference can cause deviations in the newly installed steel casing as it will tend to follow the contours of the drill hole, at least to some extent. This deviation from cylindrical (in the circumference) can result in a deflection in the down-hole pumping system assembly if the down-hole pumping system assembly is positioned in contact with any such significant deviations in the casing, which can result in a shortened lifespan and/or complete failure of the down-hole pumping system assembly.

In a process called completion, holes are generated in the casing at the reservoir depth allowing oil, gas, and other fluids to enter the well and another smaller pipe hanging from the surface wellhead is added that allows the oil and gas to be brought to the surface in a controlled manner.

In a new well the reservoir pressure is often sufficient to cause the oil and gas rise to the surface under its own pressure. Later, as the pressure decreases, or in deeper wells, additional motivation such as, for example, that provided by a down-hole pumping system assembly, is necessary.

As the oil and gas is removed, the pressure of the oil and gas in the rock pores is reduced. This reduction in pressure results in increased vertical effective stress and reservoir compaction. As the reservoir compacts, very large forces are generated which deforms the casing and added completion hardware. This deformation in the casing, whether caused by removal of the oil and gas or through other means, can also result in a deflection in the down-hole pumping system assembly which can result in a shortened lifespan and/or complete failure of the down-hole pumping system assembly.

Removal of the down-hole pumping system assembly or repair or replacement due to damage or early failure caused by irregularities in the casing of the well can result in an interruption of the oil and gas well production, which can cost millions of dollars in lost revenue. As such, recognized by the investors is the need for systems and methods for monitoring and managing/maintaining the linearity of the down-hole pumping system assembly.

Various technologies were examined to determine if alternative technologies existed to try to solve the problem recognized by the inventors. Neither of the existing alternative technologies were found to be sufficiently effective. Childers et al., Down Hole Fiber Optic Real-Time Casing Monitor, Industrial and Commercial Applications of Smart Structures Technologies 2007, Proc. of SPIE vol. 6527, 65270J (2007), incorporated herein by reference, for example, describes an application of optical fiber to perform down-hole measurements employed as part of a real-time compaction monitoring (RTCM) project being developed by the assignee of the subject invention. Particularly, Childers et al. describes a Real-Time Casing Imager (RTCI) System used, to directly measure compaction induced the formation and damage to an oil and gas well casing. The RTCI System includes surface instrumentation unit (SIU), a lead-in cable attached with standard cable clamps, and an RTCI cable connected to either the surface of the casing or to the sand-screen after drilling a well but prior to completion of the well. The attachment of the lead-in cable to the casing is performed with control line clamps which are common in the industry. The attachment of the RTCI cable to the casing or sand-screen, however, must be rigid to allow efficient strain transfer, and thus, is typically attached with an industrial adhesive. Further, the RTCI cable has a spiral or helical configuration to reduce incidences of breakage by reducing sensitivity to hoop stresses. Such configuration, however, often results in a substantial reduction in sensitivity. Also, once deployed, the RTCI cable cannot be easily repaired, if there is a breakage or some other form of damage. Accordingly, it is not expected that the RTCI system described in Childers et al. would provide sufficient sensitivity, durability, or longevity with respect to determining or managing the linearity/alignment of a down-hole pumping system assembly to a level capable of being provided by embodiments of the present invention.

Also for example, Smith, U.S. Pat. No. 6,888,124, describes utilizing a single fiber-optic cable embedded with a series of electrical wires within a stator of an electrical motor to detect overheating and/or vibrations when the associated pump is blocked or runs dry or when a bearing has worn out. Such configuration, however, would not be expected to provide sufficient sensitivity to detect static deviations within the down-hole pumping system without substantial modification. Further, as the cable is embedded with the electrical wires of the stator, even if the configuration could be modified to provide sufficient sensitivity to detect static deviations in the pump and/or motor of a down-hole pumping system assembly, such configuration would not be expected to allow the optical fiber to be readily removed, adjusted, modified, or repaired, and thus, would not be expected to provide the benefits provided by embodiments of the present invention.

SUMMARY OF THE INVENTION

In view of the foregoing, embodiments of the present invention advantageously provide systems and methods of managing the linearity of a down-hole pumping system assembly, which include electrical submersible pumps (ESPs), progressive cavity pumps (PCPs) and electrical submersible progressive cavity pumps (ESPCPs), for example. Various embodiments of the present invention advantageously also provide for adjusting the position of the down-hole pumping system assembly within a casing in order to position the down-hole pumping system assembly at an optimal location within the well casing to thereby reduces stress due to irregularities or deformations in the casing and to thereby extend the lifespan of the down-hole pumping system.

In its most basic form, an example of an embodiment of a system for monitoring the linearity of a down-hole pumping system assembly during deployment and selecting an optimal operational position for the down-hole pumping system assembly within the bore of the casing, includes a down-hole pumping system assembly connected to a distal most end of a line of production tubing and configured to function within the bore of the casing of the well to pump hydrocarbons through the line of production tubing, an optical sensing fiber configured to reflect optical signals to provide signals indicating axial strain to the motor and/or the plurality of pump stages of the down-hole pumping system assembly, a strain sensing unit, e.g., including discrete sensing and optical interrogation components, etc., configured to transmit optical signals to the optical sensing fiber and to receive optical signals reflected back from within the optical sensing fiber to detect a deflection in one or more portions of the down-hole pumping system assembly caused by a corresponding deflection in the casing of the well, and optical, electric, and mechanical couplings to connect the optical sensing fiber with the strain sensing unit. The down-hole pumping system assembly includes a pump assembly and a motor assembly connected to a distal most portion of the pump assembly via a coupling and/or to interface with a seal assembly, and/or a gas separator assembly or others.

According to an embodiment of the present invention, the optical sensing fiber is positioned within a longitudinally extending groove in at least portions of the pump assembly outer casing of the pump assembly and within a longitudinally extending groove in at least portions of the motor assembly other casing of the motor assembly. In an alternative embodiment of the present invention, a tube or other form of conduit containing the optical sensing fiber can be positioned in the groove. In another alternative embodiment of the present invention, such tube or other form of conduit containing the optical sensing fiber can be connected directly at indirectly to an outer surface of the pump and motor assemblies outer casings, for example, through use of laser welding, etc., negating a need for the grooves in the outer surface of the pump and motor assemblies outer casings.

Deviations within the bore of the casing of the well adjacent the down-hole pumping system assembly during operation can cause a deviation in alignment between one or more of the plurality of pump stages and the motor. This misalignment or lack of linearity can result in a shortened lifespan for and early failure of the down-hole pumping system's pump and/or motor assemblies which can result in an interruption in production and lost revenue. Advantageously, the strain sensing unit can include software/firmware/program product adapted to detect and locate areas of deflection within the bore of the casing to determine and/or allow the user to determine an optimal location for the down-hole pumping system assembly within the casing that minimizes fatigue to the down-hole pumping system assembly.

BRIEF DESCRIPTION OF THE DRAWINGS

So that the manner in which the features and advantages of the invention, as well as others which will become apparent, may be understood in more detail a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Figure 1:
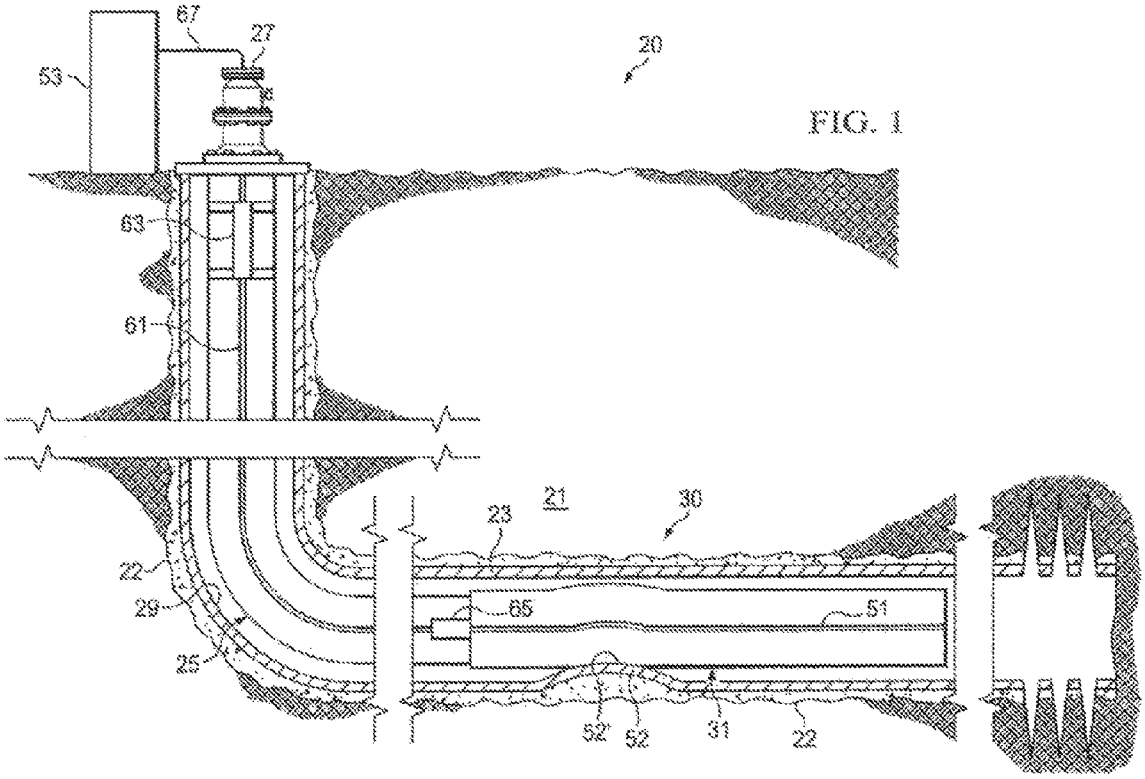
FIG. 1 is an environmental view of a system for monitoring the linearity of a down-hole pumping system assembly during deployment and selecting an optimal operational position within the bore of the casing of a well according to an embodiment of the present invention.
Figure 2A:
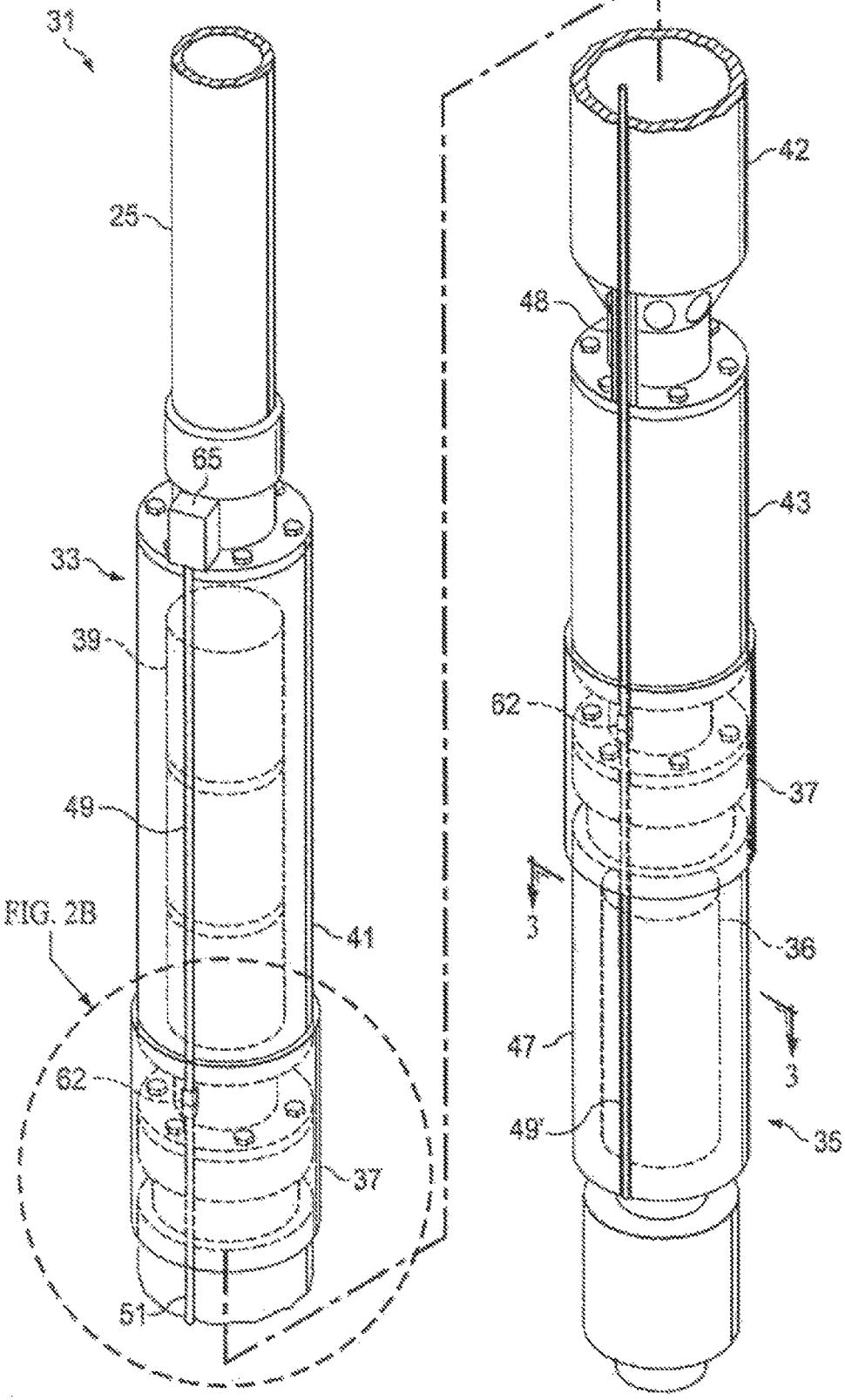
FIG. 2A is a perspective view of a down-hole pumping system assembly according to an embodiment of the present invention.
Figure 2B:
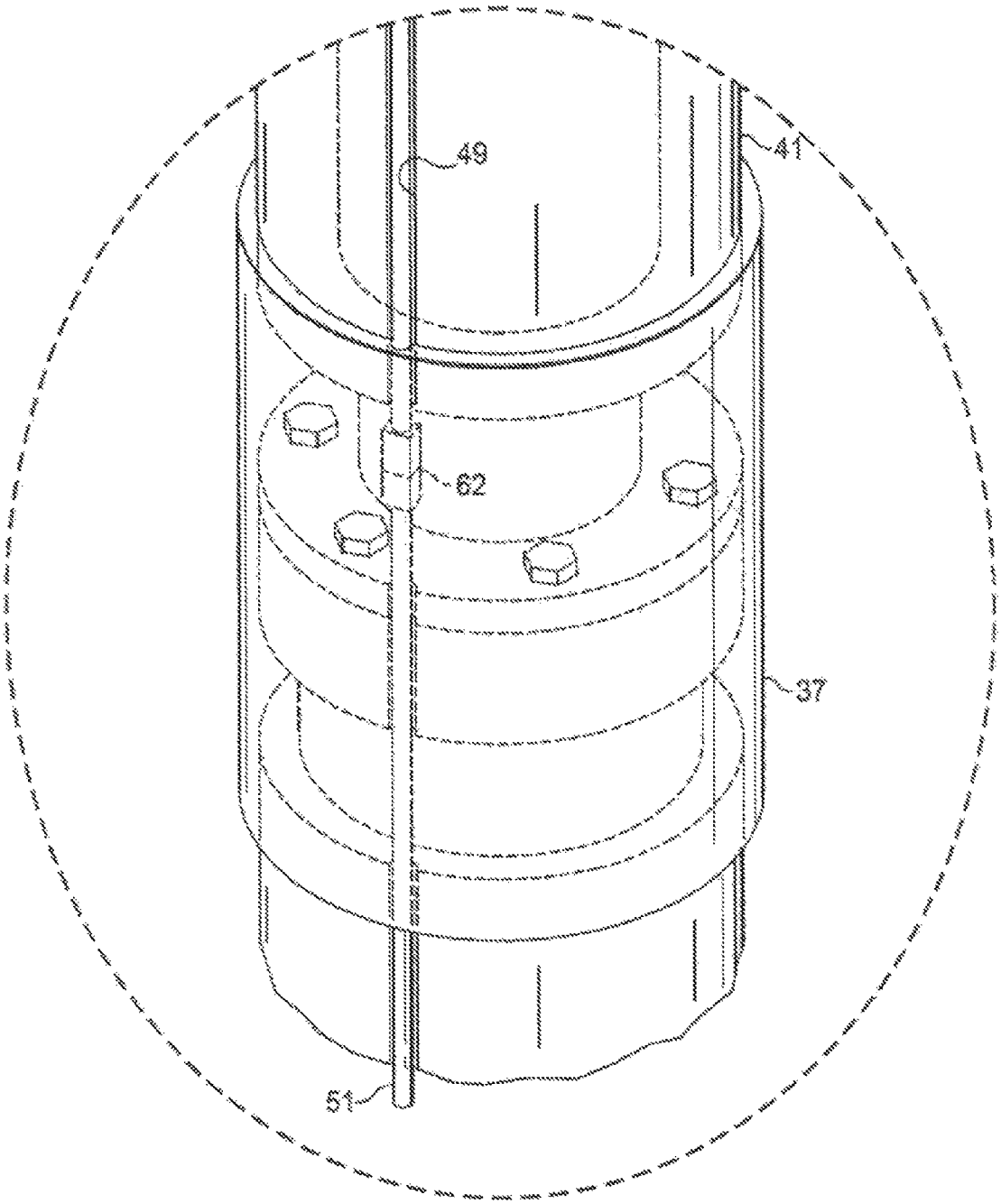
FIG. 2B is a perspective view of a coupling assembly coupling sections of a down-hole pumping system assembly according to an embodiment of the present invention.
Figure 3:
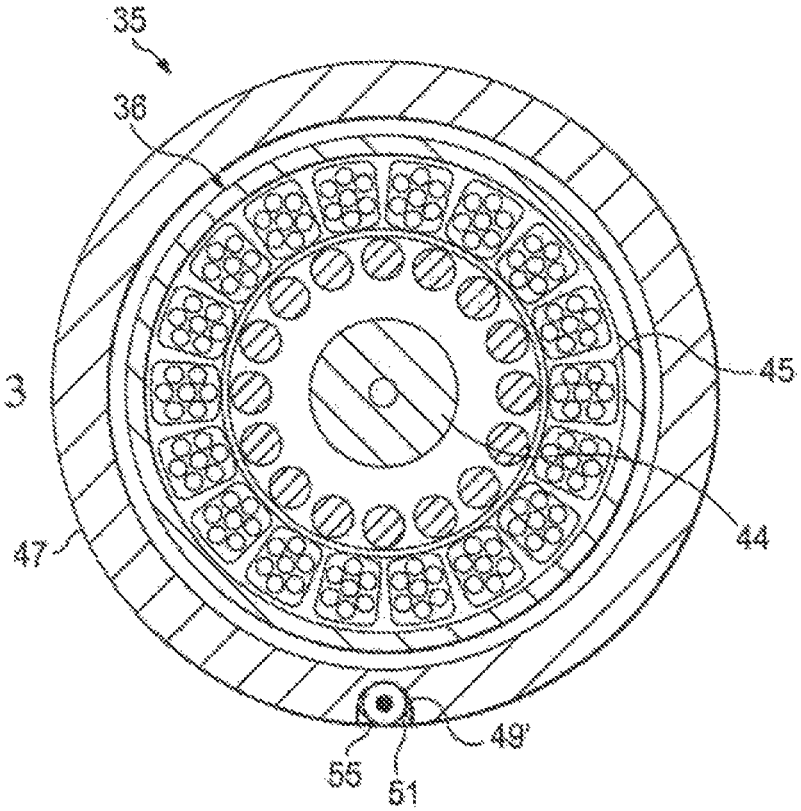
FIG. 3 is a cross-sectional view of the motor portion of the down-hose pumping system assembly of FIG. 2 taken along the 3-3 line according to an embodiment of the present invention.

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Optical fibers have become the communication medium of choice for long distance communication due to their excellent light transmission characteristics over long distances and the ability to fabricate such fibers an lengths of many kilometers. The light being transmitted can also power the sensors, thus obviating the need for lengthy electrical wires. This is particularly important in the petroleum and gas industry, where strings of electronic sensors are used in wells to monitor down-hole conditions. A string of optical fibers within a fiber-optic system can be used to communicate information from wells being drilled, as well as from completed wells, to obtain various down-hole measurements. A series of weakly reflecting fiber Bragg gratings (FBGs) may be written into a length of optical fiber, such as by photoetching, to provide down hole measurements. In principle, the distribution of light wavelengths reflected from an FBG is influenced by the temperature and strain state of the device to which the FBG is rigidly attached. Accordingly, optical fiber can be used to provide temperature, vibration, strain, and other measurements.

Various methodologies can be utilized to obtain down-hole measurements, including but not limited to, optical reflectometry in time, coherence, and frequency domains. Due to spatial resolution considerations, optical frequency-domain reflectometry (OFDR), capable of spatial resolution on the order of 100 microns or better, is a technique showing the most promise for use in oil and gas well applications. In OFDR, the probe signal is generally a continuously swept-frequency optical wave, such as from a tunable laser. The probe signal, which is optimally highly coherent, is swept around a central frequency. The probe signal is split and sent down two separate optical paths. The first path is relatively short and terminates in a reference reflector at a known location. The second path is the length of optical fiber containing the sensors. The reference reflector and the sensors in the length of optical fiber reflect optical signals back toward the source of the signal. These optical signals are converted to electrical signals by a photodetector. The signal from the reference reflector travels a shorter path, and a probe signal generated at a particular frequency at a single point in time is detected at different times from the reference reflector and the FBGs. A difference frequency component stemming from the time delay in receiving the signal from the reference reflector and the FBGs in the optical fiber can be observed in the detector signal.

As shown in FIGS. 1-10, various embodiments of the present invention employ and/or implement one or more of the above described technologies in a new and unique manner in order to allow an operator to ensure that a down-hole pumping system assembly 31 deployed down-hole at the end of a line of production tubing 25, is installed or otherwise positioned at an optimal location in a well 20, for example, by ensuring alignment across the pump stages (casing) and motor casing of the down-hole pumping system assembly 31, which can be crucial to run life the motor and the pump stages of the down-hole pumping system assembly 31.

Specifically, FIG. 1 illustrates an environmental view of a production well (e.g., an oil and gas well 20) extending into a reservoir 21. The oil and gas well 20 includes a casing 23 deployed in a borehole 22 drilled in the reservoir 21 and production tubing 25 extending through a wellhead outlet 27 of the well 20 and into the bore 29 of the casing 23. FIG. 1 also illustrates a system 30 for monitoring the linearity of a down-hole pumping system assembly 31 dining deployment and selecting an optimal operational position for the down-hole pumping system assembly 31 within the bore 29 of the casing 23, according to an exemplary embodiment of the present invention.

The system 30, in its most basic form, includes a down-hole pumping system assembly 31 connected to a distal most end of the line of production tubing 25 and configured to function within the bore 29 of the casing 23 of the well 20 to pump hydrocarbons through the line of production tubing 25. As further shown in FIGS. 2A-2B and 3A, the down-hole pumping system assembly 31 includes a pump assembly 33 and a motor assembly 35 connected to a distal most portion of the pump 33 along with various other components including, for example, a gas separator 42 and a seal section/assembly 43. The motor assembly 35 includes a motor 36 having a rotor 44 and a stator 45 contained within a motor assembly outer casing 47. The pump assembly 33 includes a plurality of longitudinally stacked pump stages 39 and a pump assembly outer casing 41. A variable speed drive and/or other such components (not shown) provide the power or other motivation force to drive the motor 36 as known and understood to those of ordinary skill in the art.

According to an embodiment of the present invention, the pump assembly outer casing 41 has at least one longitudinally oriented groove 49 for receiving a portion of an optical sensing fiber 51. Similarly, the motor assembly outer casing 47 also includes at least one longitudinally oriented groove 49' also for receiving a portion of the optical sensing fiber 51.

In this exemplary embodiment, the optical sensing fiber 51 is positioned within a longitudinally oriented grooves 49 in the pump assembly outer casing 41 and at least partially within the longitudinally extending groove 49' of the motor assembly outer casing 47 to receive and to reflect optical signals to provide signals indicating axial strain to the motor assembly 35 and/or the plurality of pump stages 39 of the pump 33 of the down-hole pumping system assembly 31. As perhaps best shown in FIG. 2B, optical connectors 62 as known to those of ordinary skill in the art can be used to connect the optical sensing fiber 51 between various assemblies/sections 33, 35, 42, 43, etc., and a coupling or other form of cover 37 can be used to couple the sections/assemblies and/or protect the optical sensing fiber 51 and optical connectors 62 extending therebetween. Additionally and/or alternatively, a tube or half-tube 48 can be used to formulate bridge between assemblies, such as, for example, the gas separator assembly 42 and the seal section assembly 43.

The optical sensing fiber 51 can be constructed to have a plurality of Bragg gratings (not shown) and/or other reflective means to provide time-spaced or frequency-dependent reflections of light signals usable to measure strain applied to the down-hole pumping system assembly 31. Note, measurements can be accomplished using optical time domain reflectometry techniques, optical frequency domain reflectometry techniques, incoherent reflectometry techniques, along with others known to those of ordinary skill in the art, and can utilize various sensing platforms, including Raman backscattering, Brillouin scattering, Rayleigh scattering, or the Bragg gratings, along with others known to those of ordinary skill in the art.

Referring again to FIG. 1, the system 30 also includes a strain sensing unit 53 configured to transmit optical signals to the optical sensing fiber 51 and to receive optical signals reflected back from within the optical sensing fiber 51 to detect a misalignment or other form of deflection 52 in one or more portions of the down-hole pumping system assembly 31 caused by a corresponding irregularity or other form of deflection 52' in the casing 23 of the well 20, and optical and electric couplings (described later) to connect the optical sensing fiber 51 with the strain sensing unit 53.

Whether pre-existing due to imperfections in the borehole 22, or occurring later during operation, such as, for example, due to reservoir compaction, deviations within the bore 29 of the casing 23 of the well 30 adjacent the down-hole pumping system assembly 31 can cause a deviation in alignment between one or more of the plurality of pump stages 39 and the motor assembly 35 or components therebetween. This misalignment or lack of linearity can result in a shortened lifespan for, and early failure of, the down-hole pumping system pump assembly 33 and/or motor assembly 35, which can result in an interruption in production and lost revenue. As such, in a preferred configuration, the strain sensing unit 53 can include software/firmware/program product or is otherwise configured to detect deflections in the down-hole pumping system assembly 31, which evidence the magnitude and location of areas of deflection within the bore 29 of the casing 23, to determine and/or allow the user to determine an optimal location for the down-hole pumping system assembly 31 within the casing 23 that minimizes fatigue to the down-hole pumping system assembly 31 caused by such deflections in the casing 23.

Referring again to FIGS. 2A and 3, according to the illustrated embodiment of the present invention, the optical sensing fiber 51 is a single-core fiber rigidly connected to an inner surface of the groove 49 in the outer surface of the pump assembly outer casing 41 and to an inner surface of the groove 49' in the outer surface of the motor assembly outer casing 47 to detect strain applied to the down-hole pumping system assembly 31 when deployed within the bore 29 of the casing 23 of the well 30. Further, according to the exemplary configuration, the groove 49 in the outer surface of the pump assembly outer casing 41 and the groove 49' in the outer surface of the motor assembly outer casing 47 is substantially filled with an epoxy 55, such that the optical sensing fiber 51 is substantially completely embedded within the groove 49 in the outer surface of the pump assembly outer casing 41 and within the epoxy 55 positioned an the groove 49' in the outer surface of the motor assembly outer casing 47. Note, other means as known to those skilled in the art can be utilized to at least partially rigidly connect the optical sensing fiber 51 to the inner surfaces of grooves 49, 49'.

Figure 4:
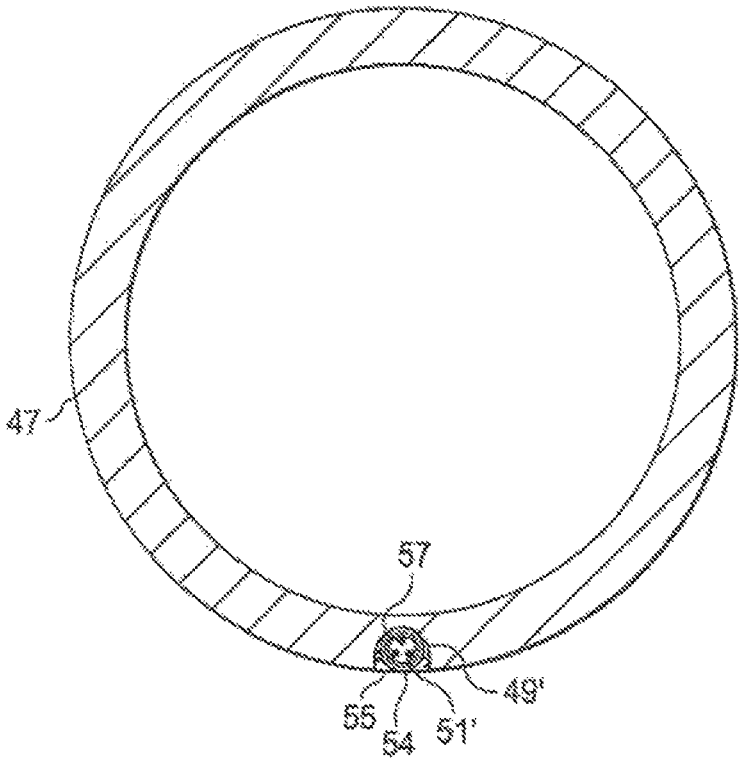
FIG. 4 is a cross-sectional view of the motor assembly outer casing of the down-hole pumping system assembly of FIG. 2 having a multi-core optical fiber according to an embodiment of the present invention.

As perhaps best shown in FIG. 4, according to an alternative embodiment of the present invention, the optical sensing fiber is in the form of a multi-core optical sensing fiber 51' slidingly positioned (not attached or non-rigidly attached) directly within the groove 49 and/or within a conduit 54 (e.g., SS, steel or plastic tube) within the groove 49 in the outer surface of the pump assembly outer casing 41 and directly within the groove 49' and/or within a conduit 54 (e.g., SS, steel or plastic tube) welded or glued within the groove 49' in the outer surface of the motor assembly outer casing 4 to allow movement therein to thereby reduce incidences of breakage due to excessive strain exceeding the strength of the optical sensing fiber 51, 51' potentially encountered by the down-hole pumping system assembly 31 when deployed within the bore 29 of the casing 23 of the well 20. That is, the down-hole pumping system assembly 31 may be subject to a deflection which would result in breakage of the optical fiber 51, 51', if rigidly connected to the assembly 31. Accordingly, in this configuration, measurements taken for each separate core 57 of the fiber 51' provide sufficient data relative to the other core member or members 57 to, in essence, allow the optical fiber 51' to provide sufficient data to the strain sensing unit 53 to determine the shape of the fiber 51' without physical attachment to a rigid or semi-rigid component undergoing a strain. That is, bends in the fiber 51' can be determined through analysis of the light signals provided by the separate cores 57 which provide data sufficient to determine strain differentials between cores 57. According to a preferred configuration, the analysis can be performed, for example, by the strain sensing unit 53 located at or near the surface.

Note, in this embodiment of the present invention, various means as known to those skilled in the art can be utilized to hold the optical sensing fiber 51' within grooves 49, 49'. These include, but are not limited to the use of a cover (not shown) placed over or flush within the outer surface portion of the outer pump and outer motor casings clamps (not shown) positioned within the grooves 49, 49' in a surrounding relationship to the optical sensing fiber 51', and loop-type fasteners (not shown), just to name a few. Further, according to another embodiment of the present invention, the conduit 54 can be laser welded or otherwise attached to an external surface of the casings 41, 47, negating a need for grooves 49, 49'.

Figure 5:
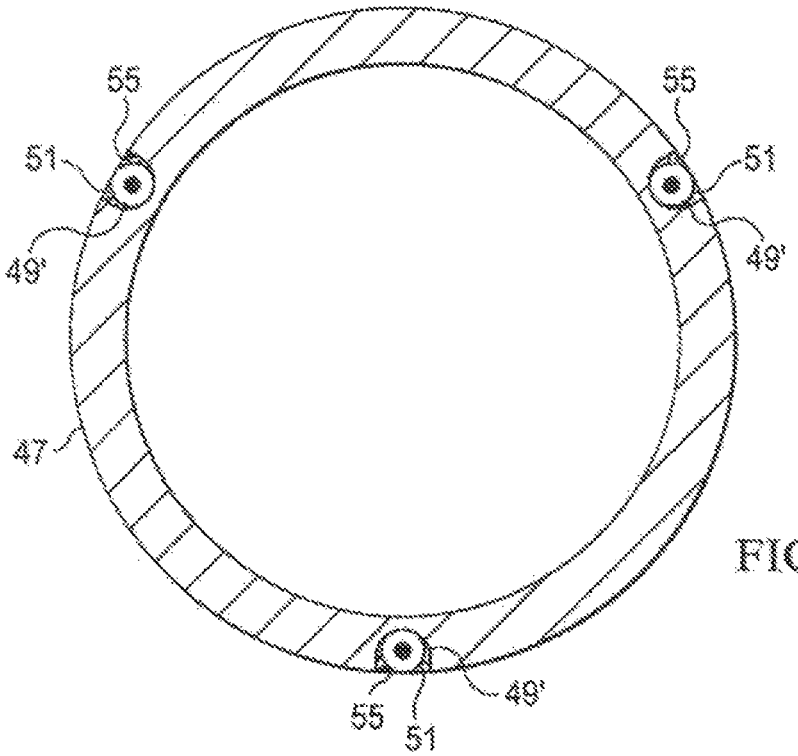
FIG. 5 is a cross-sectional view of the motor assembly outer casing of a down-hole pumping system assembly similar to that of FIG. 3, but having multiple optical fibers and optical fiber grooves according to an embodiment of the present invention.
Figure 6:
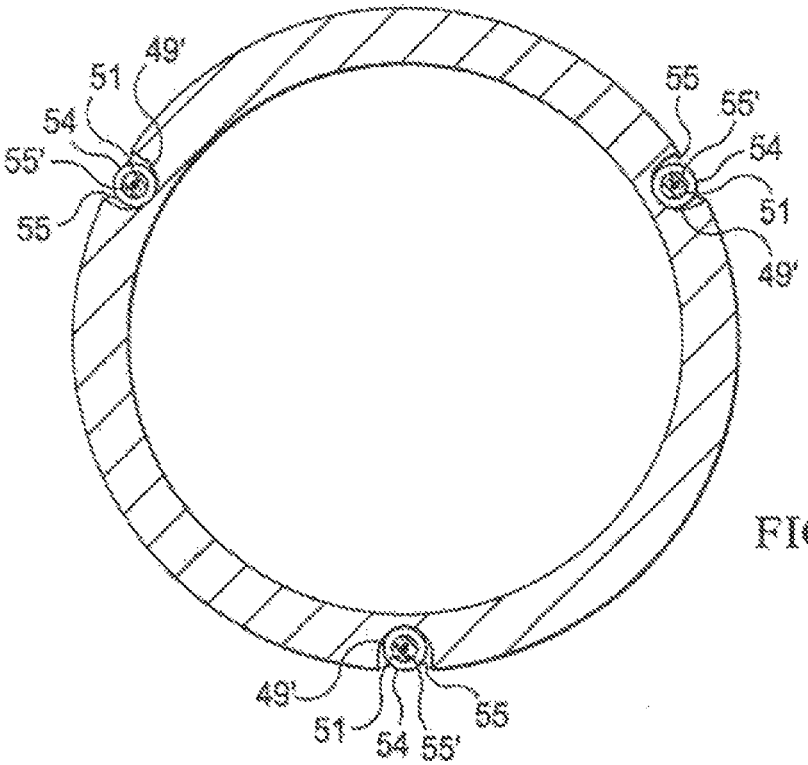
FIG. 6 is a cross-sectional view of the motor assembly outer casing of a down-hole pumping system assembly similar to that of FIG. 5, but having each optical fiber positioned within a conduit that itself is positioned in its respective optical fiber groove according to an embodiment of the present invention.
Figure 7:
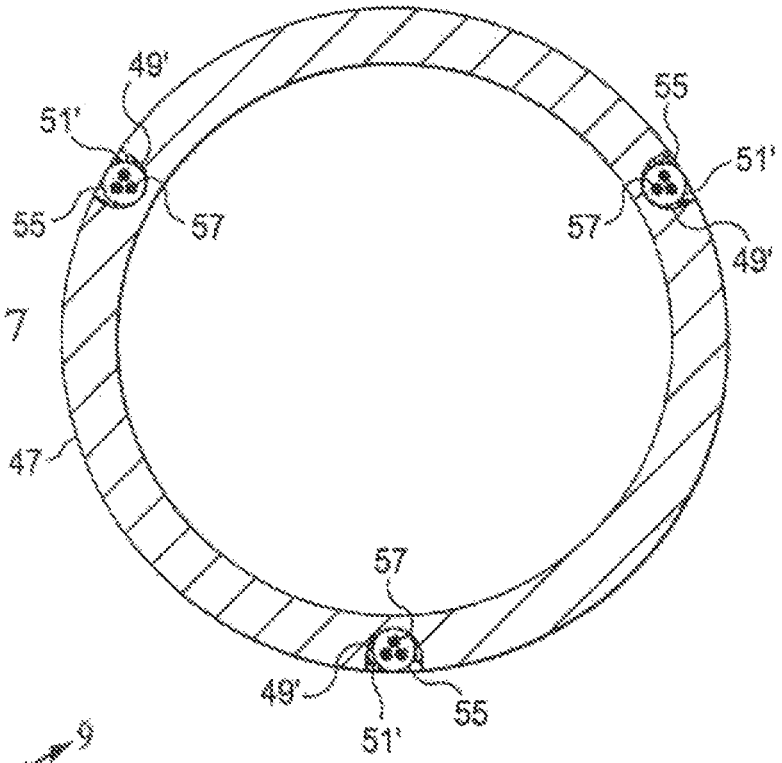
FIG. 7 is a cross-sectional view of the meter assembly outer casing of a down-hole pumping system assembly similar to that of FIG. 5, but having a multiple optical fibers within each optical fiber groove according to an embodiment of the present invention.

FIG. 5 illustrates an alternative embodiment of the present invention whereby the outer surface of the motor assembly outer casing 47 includes a plurality circumferentially spaced apart grooves 49' extending longitudinally along at least a substantial portion of the outer motor casing 47, and the outer surface of the pump assembly outer casing 41 includes a plurality of corresponding circumferentially spaced apart grooves 49 extending longitudinally along at least a substantial portion of the pump assembly outer casing 41 to thereby form a plurality of sets of optical sensing fiber grooves 49, 49', to substantially contain a corresponding plurality of optical sensing fibers 51. Note, FIG. 6 illustrates a similar alternative embodiment of the present invention but having each optical fiber 51 positioned within a conduit 54, for example, using epoxy 55', which itself is epoxied or welded within grooves 49, 49', and FIG. 7 illustrates a similar alternative embodiment of the present invention, but containing one or more multi-core fibers 51' having multiple cores 57, substituted in the place of a corresponding one or more of the single core fibers 51. Other variations or combinations are, however, within the scope of the present invention.

Figure 8:
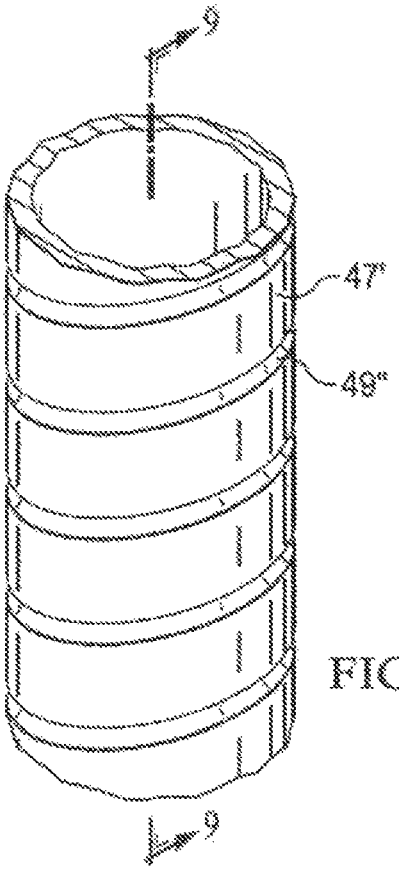
FIG. 8 is a perspective view of an outer ease thing of a motor of a down-hole pumping system assembly according to an embodiment of the present invention.
Figure 9:
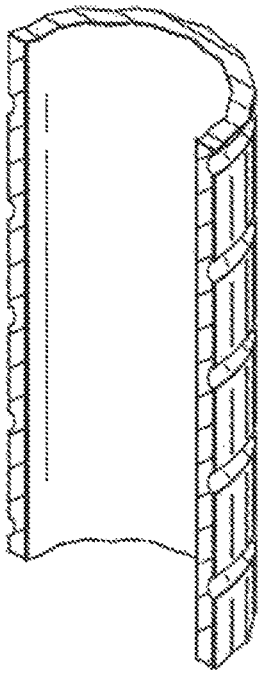
FIG. 9 is a cross-sectional view of the motor assembly outer casing of the down-hole pumping system assembly shown in FIG. 8 taken along the 9-9 line according to an embodiment of the present invention.

FIGS. 8-9 illustrate another embodiment of the present invention whereby the motor assembly outer casing 47' and/or the pump assembly outer casing and/or outer casing of one or more of the other assemblies/sections of the down-hole pumping system assembly include a helical shape to groove 49". Other variations or combinations including the use of conduits or tubes having various shapes and/or direct tube or fiber connection to an outer surface of the casings 41, 45, are within the scope of the present invention.

Referring again to FIG. 1, the system 30 can also include a down-hole cable 61, for example, extending through a wellhead outlet 27 or otherwise extending down-hole, and connected to an outer surface of the production tubing 25 via a clamp such as, for example, a cannon clamp 63 to transfer optical signals between the strain sensing unit 53 and the optical sensing fiber or fibers 51, 51'. The system 30 also includes an opposing ferrite seal 65 and/or other form of mechanical and electrical connector connected to the down-hole cable 61 and to the optical sensing fiber or fibers 51, 51' to provide an interface between the cable 61 and the fiber or fibers 51, 51', and a surface cable 67 extending through the wellhead outlet 27 and connected to the down-hole cable 61 and to the strain sensing unit 53 to transfer optical signals between the strain sensing unit 53 and down-hole cable 61 and the optical sensing fibers 51, 51'.

Figure 10:
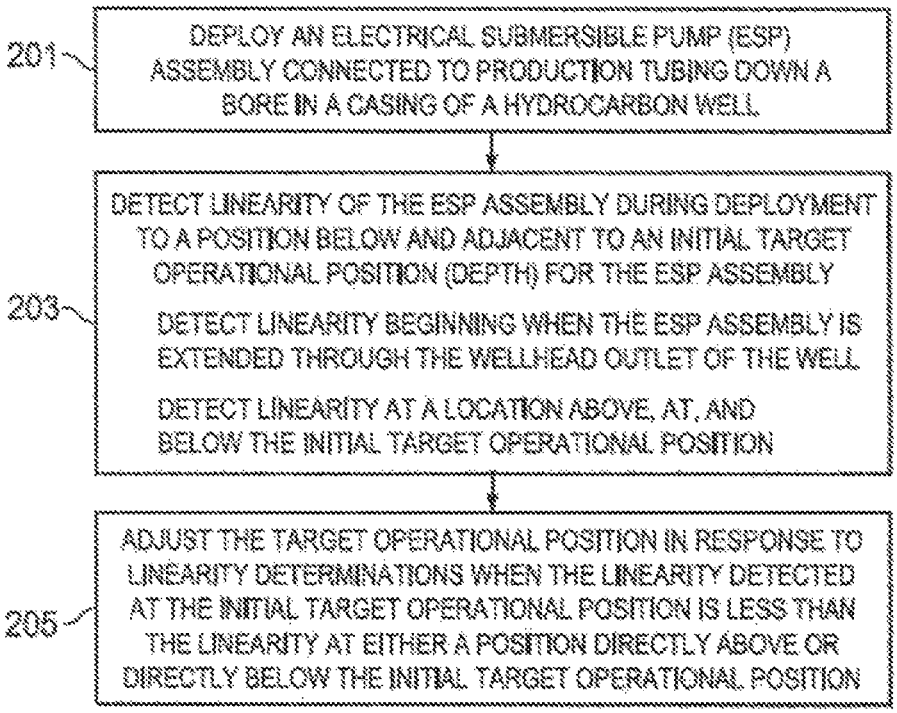
FIG. 10 is a schematic block flow diagram of a method of monitoring the linearity of a down-hole pumping system assembly during deployment and selecting an optimal position for the down-hole pumping system assembly according to an embodiment of the present invention.

Embodiments of the present invention can include methods of managing the down-hole pumping system assembly 31 during deployment within the bore 29 of the casing 23 of a hydrocarbon well such as, for example, seed 20 positioned to extract hydrocarbons from a subterranean reservoir such as, for example, reservoir 21 (see, e.g., FIG. 1). FIG. 10, for example, illustrates a flow diagram of an example of a method of monitoring the linearity of a down-hole pumping system assembly 31 during deployment and selecting an optimal position for the down-hole pumping system assembly 31 within the bore 29 of the casing 23 of the well 20. According to the illustrated example, the method can include the steps of deploying the down-hole pumping system assembly 31 connected to production tubing 25 down the bore 29 in the casing 23 of the well 20 (block 201), detecting linearity of the down-hole pumping system assembly 31 during deployment to a position below and adjacent to an initial target operational position for the assembly 31 (block 203), and adjusting the target operational position in response to linearity determinations above and below the initial target operational position when the linearity detected at the initial target operational position is less than the linearity at either a position directly above or directly below the initial target operational position (block 205).

For example, assume a pre-planned depth/down-hole location to be 1000 feet. During deployment of the down-hole pumping system assembly 31 to a depth of about 1020 feet, the down-hole pumping system assembly 31 suffers a substantial deflection 52 at the 1000 foot depth and at the 1020 foot depth, most likely caused by a corresponding irregularity 52' in the casing 23 of the well 20 (see, e.g., FIG. 1). There was only a slight deflection 52 at the 1010 foot depth and so appreciable deflection 52 at the 990 foot depth. Accordingly, the 990 foot depth or 1010 foot depth will be selected in place of the original planned 1000 foot depth. Note, in most instances, it will be expected that be position deemed to be ideal based on linearity readings will typically be between pins or minus 10 feet of the original target location, although larger positional selections are within the scope of the present invention.

Further, according to an alternative embodiment of the method, the operators can run a non-functional down-hole pumping system assembly or other form of simulator (not shown), for example, typically having similar outer surface dimensions and/or length to first detect down-hole casing conditions via the above described system 30 prior to deployment of the functional down-hole pumping system assembly 31, to thereby beneficially reduce incidents of damage to the functional down-hole pumping system assembly 31, which can occur when deviations within the bore 29 of the casing 23 of the well 20 exist that would exceed the deflection capabilities of the functional down-hole pumping system assembly 31 during deployment thereof.

It is important to note that while embodiments of the present invention have been described in the context of a fully functional system, those skilled in the art will appreciate that the mechanism of at least portions of the present invention and/or aspects thereof are capable of being distributed in the form of a computer readable medium of instructions in a variety of forms for execution on a processor, processors, or the like, and that embodiments of the present invention apply equally regardless of the particular type of signal bearing media used to actually carry out the distribution. Examples of computer readable media include, but are not limited to: nonvolatile, hard-coded type media such as read only memories (ROMs), CD-ROMs, and DVD-ROMs, or erasable, electrically programmable road only memories (EEPROMs), recordable type media such as floppy disks, hard disk drives, CD-R/RWs, DVD-RAMs, DVD-R/RWs, DVD+R/RWs, flash drives, and other newer types of memories, and transmission type media such as digital and analog communication links. For example, such media can include both operating instructions and operations instructions related to the function of the strain sensing unit 53 and the computer implementable portions of method steps/operations, described above.

Various embodiments of the present invention have several advantages. For example, various embodiments of the present invention allow an operator to ensure that a motor 35 and pump 33 of a down-hole pumping system assembly 31 are installed in an optimal position in a well 20 by ensuring alignment across the pump stages casing 41 and motor casing 47. The alignment and linearity of the pump 33 and motor 35 can be crucial to run life of the pump 33 and/or motor 35. By attaching an optical fiber 51, 51' along the length of the pump and motor casings 41, 47 any deviation in the linearity of the pump 33 and motor 35 can be detected using, e.g., strain measurements. Examples of measurement techniques that can be used to measure strain include optical time domain reflectometry techniques and/or optical frequency domain reflectometry techniques employing Raman backscattering, and/or use of fiber bragg gratings to detect strain in the outer casings 41, 47, and thus, also in the casing 23. The shape of the pump and motor casings 41, 47 can be determined by using analysis techniques to interpret strain measurements across the casings 41, 47. Various embodiments of the present invention also employ fiber-optic shape sensing methodologies such as, for example, the employment of multi-core fibers 51' wherein strain differentials are used to infer local bends or global shape, helical core fibers, as well as others.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention, as described in the foregoing specification.

The invention claimed is:

1. A method of monitoring linearity of a down-hole pumping system assembly deployed within a bore of a casing of a well, the method comprising the steps of:

deploying the down-hole pumping system assembly down the well;

monitoring linearity of the down-hole pumping system assembly to thereby optimize a lifespan of the down-hole pumping system assembly; and adjusting the operational position of the down-hole pumping system assembly in response to linearity determinations exceeding a threshold value.

2. The method according to claim 1, wherein the step of monitoring linearity of the down-hole pumping system assembly includes detecting linearity of the down-hole pumping system assembly during deployment to a position below and adjacent to an initial target operational position for the assembly.

3. The method as defined in claim 2, further comprising the step of:

adjusting the target operational position in response to linearity determinations above and below the initial target operational position when the linearity detected at the initial target operational position is less than the linearity at either a position directly above or directly below the initial target operational position.

4. The method according to claim 1, wherein the step of detecting the linearity of the down-hole pumping system assembly is performed for substantially during an entire portion of the deployment below a well-head outlet for the well.

5. The method according to claim 1, wherein the down-hole pumping system assembly is a non-functional down-hole pumping system assembly deployed to detect down-hole casing conditions prior to deployment of a functional down-hole pumping system assembly.

6. The method according to claim 1, wherein the down-hole pumping system assembly is a down-hole pumping system assembly simulator deployed to detect down-hole casing conditions prior to deployment of a functional down-hole pumping system assembly.

7. A system for monitoring linearity of an electrical submersible pump assembly during deployment within a bore of a casing of a well having a wellhead, the system comprising:

a submersible pump assembly having a plurality of modules including a pump, a motor, and a seal section, the submersible pump assembly adapted to be lowered into the well on a string of tubing;

a first one of the modules including a housing having an outer surface that has a first groove extending along at least a substantial portion of the first one of the modules;

a first optical sensing fiber positioned within the first groove, the first optical sensing fiber configured to reflect optical signals to provide signals indicating axial strain to the first one of the modules;

a down-hole cable connected to the first optical sensing fiber and adapted to extend alongside the tubing to the wellhead; and a strain sensing unit for location adjacent the wellhead and connected to the down-hole cable, the strain sensing unit configured to transmit optical signals through the down-hole cable to the first optical sensing fiber and to receive optical signals reflected back through the down-hole cable from within the first optical sensing fiber to detect a deflection in the first one of the modules caused by a corresponding deflection in the casing of the well.

8. The system according to claim 7, further comprising:

a second one of the modules having a housing with an outer surface that has a second groove extending along at least a substantial portion of the second one of the modules;

a second optical sensing fiber positioned within the second groove, the second optical sensing fiber configured to reflect optical signals to provide signals indicating axial strain to the second one of the modules;

an optical connector that connects the first optical sensing fiber to the second optical sensing fiber; and wherein the strain sensing unit is configured to transmit optical signals both to the first optical sensing fiber and to the second optical sensing fiber and to receive optical signals reflected back from within the first optical sensing fiber and the second optical sensing fiber through the down-hole cable to detect deflections in the first one of the modules and in the second one of the modules caused by a corresponding deflection in the casing of the well.

9. The system according to claim 8, wherein the first one of the modules comprises the pump and the second one of the modules comprises the motor.

10. The system according to claim 8, wherein:

the first one of the modules and the second one of the modules are connected together at a neck of lesser outer diameter than the outer surfaces of the housings; and wherein the system further comprises:

a bridge member extending parallel to the axis across the neck; and wherein at least one of the first and second optical sensing fibers extends along and is supported by the bridge member.

11. The system according to claim 7, wherein the groove extends helically around the housing of the first one of the modules.

12. The system according to claim 7, further comprising:

a tube rigidly bonded inside the groove; and wherein the first optical sensing fiber is located within the tube and is axially movable relative to the tube.

13. A system for monitoring linearity of an electrical submersible pump assembly during deployment within a bore of a casing of a well having a wellhead, the system comprising:

an electrical submersible pump assembly adapted to be lowered into the well with a string of tubing, the assembly including a pump comprising a plurality of longitudinally stacked pump stages and a motor operatively connected to the pump;

the motor including a motor housing having an outer surface including a groove extending longitudinally along at least a substantial portion of the motor housing and parallel to a longitudinal axis of the electrical submersible pump assembly;

the pump including a pump housing having an outer surface including a groove extending longitudinally along at least a substantial portion of the pump housing and parallel to the longitudinal axis of the electrical submersible pump assembly;

the groove in the outer surface of the motor housing further positioned to align with the groove in the outer surface of the pump housing;

an optical sensing fiber positioned within the groove of the pump housing and at least partially within the groove of the motor housing, the optical sensing fiber configured to reflect optical signals indicating axial strain to submersible pump assembly;

a strain sensing unit configured to transmit optical signals to the optical sensing fiber and to receive optical signals reflected back from within the optical sensing fiber to detect a deflection in one or more portions of the electrical submersible pump assembly caused by a corresponding deflection in the casing of the well to thereby determine an optimal location for the electrical submersible pump assembly within the bore of the casing that minimizes fatigue to the electrical submersible pump assembly resulting from a deviation in alignment between one or more of the plurality of pump stages and the motor;

a down-hole cable connected to the strain sensing unit for extending through the wellhead alongside the tubing, the down-hole cable being connected to the optical sensing fiber to transfer optical signals between the strain sensing unit and the optical sensing fiber;

a seal connected to the down-hole cable and to the optical sensing fiber to provide an interface therebetween; and a surface cable extending through the wellhead outlet and connected to the down-hole cable and to the strain sensing unit to transfer optical signals between the strain sensing unit and the optical sensing fiber.

14. The system according to claim 13, wherein:

the optical sensing fiber has a pump fiber segment located in the groove of the pump and a separate motor fiber segment located in the groove of the motor; and wherein the system further comprises:

an optical connector that connects the pump fiber segment to the motor fiber segment.

15. The system according to claim 13, wherein:

the pump and the motor are connected together at a neck of lesser outer diameter than the outer surfaces of the housings of the pump and the motor; and wherein the system further comprises:

a bridge member extending parallel to the axis across and outwardly spaced from the neck; and wherein the optical sensing fiber extends along and is supported by the bridge member.

16. The system according to claim 13, wherein the groove in the outer surface of the housing of the motor extends helically around the axis.

17. The system according to claim 13, wherein the groove in the outer surface of the housing of the pump extends helically around the axis.

18. The system according to claim 13, wherein:

the groove in the outer surface of the housing of the motor extends helically around the axis; and the groove in the outer surface of the housing of the pump extends helically around the axis.

19. The system according to claim 13, further comprising:

a tube rigidly bonded inside the groove of the motor housing; and wherein the optical sensing fiber is located within the tube and is axially movable relative to the tube.

20. The system according to claim 13, wherein the seal connected to the down-hole cable and to the optical sensing fiber is located at an upper end of the electrical submersible pump assembly.

* * * * *